US011180357B2

(12) United States Patent
Yuse et al.

(10) Patent No.: US 11,180,357 B2
(45) Date of Patent: Nov. 23, 2021

(54) GAS REPLACEMENT SYSTEM AND GAS REPLACEMENT METHOD

(71) Applicants: MITSUBISHI HEAVY INDUSTRIES MACHINERY SYSTEMS, LTD., Hyogo (JP); Toyo Seikan Co., Ltd., Tokyo (JP)

(72) Inventors: Hidehiko Yuse, Tokyo (JP); Kazuyuki Kurosawa, Tokyo (JP); Yukio Takada, Aichi (JP); Shinji Ishikura, Aichi (JP); Norio Inukai, Aichi (JP); Katsumi Sembon, Kanagawa (JP)

(73) Assignees: MITSUBISHI HEAVY INDUSTRIES MACHINERY SYSTEMS, LTD., Hyogo (JP); TOYO SEIKAN CO., LTD., Tokyo (JP)

( * ) Notice: Subject to any disclaimer, the term of this patent is extended or adjusted under 35 U.S.C. 154(b) by 522 days.

(21) Appl. No.: 15/746,862

(22) PCT Filed: Aug. 22, 2016

(86) PCT No.: PCT/JP2016/003809
§ 371 (c)(1),
(2) Date: Jan. 23, 2018

(87) PCT Pub. No.: WO2017/033454
PCT Pub. Date: Mar. 2, 2017

(65) Prior Publication Data

US 2020/0079635 A1 Mar. 12, 2020

(30) Foreign Application Priority Data

Aug. 24, 2015 (JP) ..... JP2015-165232

(51) Int. Cl.
*B67C 3/22* (2006.01)
*B67C 3/24* (2006.01)
*B67C 7/00* (2006.01)

(52) U.S. Cl.
CPC ..... *B67C 3/222* (2013.01); *B67C 3/225* (2013.01); *B67C 3/24* (2013.01); *B67C 7/0053* (2013.01);
(Continued)

(58) Field of Classification Search
CPC ..... B65B 31/04; B65B 31/025; B65B 31/028; B65B 31/027; B65B 55/10; B65B 55/18;
(Continued)

(56) References Cited

U.S. PATENT DOCUMENTS 3,899,862 A * 8/1975 Muys ..... B65B 55/10 53/426
4,014,158 A * 3/1977 Rausing ..... B65B 55/025 53/167
(Continued)

FOREIGN PATENT DOCUMENTS

JP 50-50187 A 5/1975
JP H05330515 A 12/1993
(Continued)

OTHER PUBLICATIONS

Wholly—Definition by Merriam-Webster Online Dictionary, retrieved from URL https://www.merriam-webster.com/dictionary/wholly on Sep. 25, 2020 (Year: 2020).*
(Continued)

*Primary Examiner* — Valentin Neacsu
(74) *Attorney, Agent, or Firm* — Kanesaka Berner and Partners LLP

(57) ABSTRACT

To reduce an amount of use of a replacement gas used for replacing air in a container. A gas replacement system
(Continued)

includes: a washing machine that washes the container with water; a filling machine that fills the container with a content fluid; a sealing machine that seals the container transferred from the filling machine; a chamber that covers the filling machine and the sealing machine, and contains a replacement gas; and a water discharge mechanism (washing machine) that discharges the water in the container having been carried into the chamber while containing the water out of the container in the chamber. The water in the container is replaced with an ambient gas in the chamber along with the discharge of the water.

18 Claims, 8 Drawing Sheets

(52) U.S. Cl.
CPC *B67C 2007/006* (2013.01); *B67C 2007/0066* (2013.01)

(58) Field of Classification Search
CPC ..... B65B 55/025; B67C 3/00; B67C 3/222; B67C 3/225; B67C 3/24; B67C 2007/006; B67C 2007/0066
USPC ..... 53/432, 510, 110; 141/64
See application file for complete search history.

(56) References Cited

U.S. PATENT DOCUMENTS 4,717,575 A * 1/1988 Larroche ..... A23L 3/0155 220/203.09
8,388,761 B2 * 3/2013 Iwashita ..... A61L 2/22 134/166 R
9,227,747 B2 * 1/2016 Dupont ..... B65B 3/18
2002/0085971 A1 * 7/2002 Raniwala ..... A61L 2/186 422/303
2010/0229895 A1 * 9/2010 Iwashita ..... A61L 2/22 134/22.1
2012/0297732 A1 * 11/2012 Dupont ..... B65B 3/18 53/432
2012/0308699 A1 * 12/2012 Dupont ..... B65B 3/18 426/397
2013/0078116 A1 3/2013 Washizaki et al.
2013/0092196 A1 * 4/2013 Nagatani ..... B08B 9/32 134/26

FOREIGN PATENT DOCUMENTS

JP H06179428 A 6/1994
JP 9-323793 A 12/1997
JP 10-61993 A 3/1998
JP 2014-73855 A 4/2014
WO 2011/151902 A1 7/2013

OTHER PUBLICATIONS

Seal—definition by the Merriam-Webster Online Dictionary, retrieved from URL https://www.merriam-webster.com/dictionary/seal on Dec. 15, 2020 (Year: 2020).*
With—dictionary definition by Merriam-Webster, retrieved from URL https://www.merriam-webster.com/dictionary/with on May 5, 2021 (Year: 2021).*
Directly—dictionary definition by Merriam-Webster, retrieved from URL https://www.merriam-webster.com/dictionary/DIRECTLY on May 5, 2021 (Year: 2021).*
Written Opinion in PCT/JP2016/003809 dated Nov. 22, 2016. 15pp.
International Search Report in PCT/JP2016/003809 dated Nov. 22, 2016. 5pp.
Office Action for Japanese Application No. 2015-165232 dated Dec. 11, 2018; 9pp.

* cited by examiner

GAS REPLACEMENT SYSTEM AND GAS REPLACEMENT METHOD

RELATED APPLICATIONS

The present application is a National Phase of PCT/JP2016/003809, filed Aug. 22, 2016, and claims priority based on Japanese Patent Application No. 2015-165232, filed Aug. 24, 2015.

TECHNICAL FIELD

The present invention relates to a gas replacement system that fills a container with a content fluid such as a beverage, seals the container, and replaces contents of the container with a gas, and a gas replacement method.

BACKGROUND ART

Beverage manufacturing facilities for manufacturing a container such as a can filled with a content fluid such as a beverage includes, in a chamber, a filling machine that fills the container with the content fluid. In order to prevent an oxygen gas contained in air in the container from impairing quality of the content fluid, the filling machine performs gassing for blowing a replacement gas, for example, a carbon dioxide gas (replacement fluid) supplied from a tank as a supply source into the container (for example, Patent Literature 1). For such gassing, non-seal gassing for blowing the carbon dioxide gas into the container without closing an opening of the container to expel the air in the container out of the container may be combined with seal gassing for blowing the carbon dioxide gas from a nozzle of the filling machine into the container after closing the opening of the container with the nozzle to ensure a degassing path in the nozzle. By the gassing, the air in the container is replaced with the carbon dioxide gas, and then the container is filled with the content fluid.

The container filled with the content fluid is transferred to a sealing machine that attaches a lid to seal the container. The sealing machine performs undercover gassing for blowing the carbon dioxide gas between the lid and the container and blowing air in a head space that is a space above a fluid level in the container out of container, and then seals the container (for example, Patent Literature 2).

CITATION LIST

Patent Literature

Patent Literature 1: JP2014-73855 A
Patent Literature 2: WO 2011/151902 A1

SUMMARY OF INVENTION

Technical Problem

The filling machine and the sealing machine in the conventional beverage manufacturing facility are provided in a room under the atmosphere.

Thus, even if the gassing by the filling machine replaces the air in the container with the carbon dioxide gas, a part of the carbon dioxide gas in the container leaks into the atmosphere while the container is transferred from the filling machine to the sealing machine, and thus air enters the container by an amount of the leakage. In anticipation of this, an increased amount of carbon dioxide gas is used for the gassing by the filling machine and the sealing machine, thereby achieving a requested concentration of an oxygen gas.

Not only while the container is transferred from the filling machine to the sealing machine as described above, but also during the non-seal gassing or the undercover gassing, an excessive carbon dioxide gas leaks into the atmosphere. Also, in a snifting step when the container is filled with the content fluid, a carbon dioxide gas for differential pressure of the head space leaks into the atmosphere.

Specifically, a more excessive amount of carbon dioxide gas than an amount required for keeping the requested concentration of the oxygen gas that remains in the container below a certain level is supplied from the supply source and used for the gassing. It is preferable to reduce an amount of use of the carbon dioxide gas in terms of cost for the carbon dioxide gas and also of safety in working environment and protection of natural environment.

Therefore, the present invention has an object to provide a gas replacement system and a gas replacement method capable of reducing an amount of use of a replacement gas that is required for replacing air in a container and supplied from a supply source.

Solution to Problem

As described above, a replacement gas leaking from a container during gassing, during snifting in filling with a content fluid, or during transfer from a filling machine to a sealing machine accumulates around the container or a region away from the container in a chamber. If the replacement gas can be collected and blown into the container, an amount of use of the replacement gas supplied from a supply source can be reduced.

Further, an amount of use of the replacement gas can be also reduced by creating a space having a high concentration of replacement gas in the chamber, and replacing contents of the container with the replacement gas in the space while keeping the concentration of the replacement gas in the space.

A gas replacement system according to the present invention achieved based on the above idea is a gas replacement system that fills a container with a content fluid, seals the container, and replaces contents of the container with a gas, including: a filling machine that fills a container with a content fluid; a sealing machine that seals the container transferred from the filling machine; a chamber that covers the filling machine and the sealing machine, and contains an ambient gas containing a replacement gas based on a supply source; and a liquid discharge mechanism that discharges a liquid in the container having been carried into the chamber while containing the liquid out of the container in the chamber, wherein the liquid in the container is replaced with the ambient gas in the chamber along with the discharge of the liquid.

The liquid introduced into the container in the present invention is used as a medium to be replaced with the gas in the chamber containing the replacement gas.

In the present invention, the container containing the liquid is carried into the chamber containing the replacement gas, and the liquid is discharged from the container in the chamber to replace the contents of the container with the ambient gas contained in the chamber.

If the container carried into the chamber contains no liquid, the container is filled with the atmosphere, and thus the atmosphere in the container also enters the chamber as the container is carried into the chamber. However, in the present invention, the container containing the liquid is carried, and thus the container can be carried into the chamber without the atmosphere. Specifically, preventing a reduction in the concentration of the replacement gas in the chamber caused by the atmosphere in the container being brought into the chamber allows the contents of the container to be efficiently replaced with the replacement gas in the chamber while keeping the concentration of the replacement gas in the chamber.

Also, supplying the replacement gas into the chamber to increase the concentration of the replacement gas can make internal pressure of the chamber positive with respect to the atmosphere, thereby preventing entry of foreign matters from outside into the chamber.

The gas replacement system according to the present invention preferably includes a gassing system that introduces the replacement gas based on the supply source into the container, the liquid in the container having been replaced with the ambient gas in the chamber along with the discharge of the liquid, to replace the gas in the container with the replacement gas.

Since the filling machine and the sealing machine are covered with the chamber, an excess of the replacement gas blown into the container by the gassing system, or the replacement gas leaking from inside to outside the container during snifting or transfer from the filling machine to the sealing machine exists in the chamber as the ambient gas.

Thus, if the container is carried into the chamber while containing the liquid and the liquid in the container is discharged by the liquid discharge mechanism in the chamber, the ambient gas in the chamber containing the replacement gas is introduced into the container. Thus, the liquid in the container is replaced with the gas in the chamber. Then, the concentration of the replacement gas in the container is higher than in the atmosphere. Thus, as compared to the case where the replacement gas is introduced into the container filled with the atmosphere, gassing with a smaller amount of replacement gas can achieve a sufficient concentration of the replacement gas in the container.

Even if the replacement gas leaks from the container after the processing by the gassing system, and the gas in the chamber enters the container by an amount of the leakage, the concentration of the replacement gas in the chamber is higher than in the atmosphere, thereby preventing a reduction in the concentration of the replacement gas in the container.

The replacement gas having leaked around the container before the container is sealed remains in the chamber and is introduced into the container as the liquid in the container supplied into the chamber is discharged.

The gassing system in the present invention can perform the gassing one or more times at any timing before and after filling with the content fluid. For example, non-seal gassing may be first performed and seal gassing may be then performed.

In the present invention, the ambient gas in the chamber is introduced into the container along with the discharge of the lid in the container to increase the concentration of the replacement gas in the container, and then the gassing is performed, thereby reducing an amount of use of the replacement gas supplied from the supply source.

According to the present invention, almost all of the replacement gas having once introduced into the container and leaked from the container can be collected in the chamber and again introduced into the container. This can achieve a predetermined concentration of a remaining oxygen gas while significantly reducing the amount of use of the replacement gas supplied from the supply source.

Also, the inside of the chamber is at positive pressure with respect to the atmosphere by the replacement gas being blown by the gassing system, thereby preventing entry of foreign matters from outside into the chamber.

The gassing system in the present invention may be such that a gas is supplied in a gas phase from the supply source, or supplied in a liquid phase from the supply source.

For the former case, the replacement gas introduced into the container remains in the container, and thus the gas in the container is replaced with the replacement gas. On the other hand, for the latter case, a replacement liquid in a liquid phase introduced into the container is vaporized in the container, and thus the gas in the container is replaced with the replacement gas. An example of the replacement liquid introduced into the container in the latter case may be nitrogen ($N_2$). If the replacement liquid as the replacement gas in the liquid phase is sprayed or dropped into the container, volume expansion caused by vaporization of the replacement liquid removes the gas in the container out of the container.

The gas replacement system according to the present invention may include a liquid supply system that introduces the liquid into the container before the container is carried into the chamber.

In the gas replacement system according to the present invention, the liquid discharge mechanism preferably changes a position of the container to discharge the liquid in the container from an opening of the container under its own weight.

It is preferable that the gas replacement system according to the present invention includes a washing machine that washes the container with the liquid upstream of the filling machine, and that the washing machine functions as at least one of the liquid discharge mechanism and the liquid supply system that introduces the liquid into the container before the container is carried into the chamber.

In the gas replacement system according to the present invention, it is preferable that the washing machine functions as the liquid discharge mechanism, and that the chamber covers a position where the liquid is discharged from the container in the washing machine.

In the gas replacement system according to the present invention, it is preferable that the washing machine includes a gripper capable of changing the position of the container while gripping the container, and that the gripper functions as the liquid discharge mechanism.

In the gas replacement system according to the present invention, it is preferable that a conveying path along which the container is conveyed in the washing machine includes a twist section constituted by a guide member twisted to change the position of the container while guiding the container, and the twist section functions as the liquid discharge mechanism.

It is preferable that the gas replacement system according to the present invention includes a liquid supply system that introduces the liquid between the containers at a position where the containers are carried into the chamber.

A gas replacement method according to the present invention is a method for replacing contents of a container with a gas in filling the container with a content fluid and sealing the container, including: a first step of covering a conveying path along which the container is conveyed for filling and sealing with a chamber so that the chamber contains a replacement gas, and introducing a liquid into the container before the container is carried into the chamber; and a second step of discharging the liquid in the container out of the container in the chamber to replace the liquid in the container with the gas in the chamber.

It is preferable that the gas replacement method according to the present invention includes a third step of introducing a replacement fluid supplied from a supply source into the container in the chamber, the liquid in the container having been replaced with the gas in the chamber along with the discharge of the liquid, to replace the gas in the container with the replacement gas that is the replacement fluid in a gas phase.

In the gas replacement method according to the present invention, the first step may include washing the container with the liquid and introducing the liquid into the container.

In the gas replacement method according to the present invention, it is preferable that the first step includes introducing the liquid between the containers adjacent in a conveying direction when the containers are carried into the chamber.

Advantageous Effect of Invention

According to the present invention, an amount of use of a replacement gas supplied from a supply source and required for replacing air in a container can be reduced.

DESCRIPTION OF EMBODIMENTS

Now, with reference to the accompanying drawings, embodiments of the present invention will be described.

First Embodiment

Figure 1:
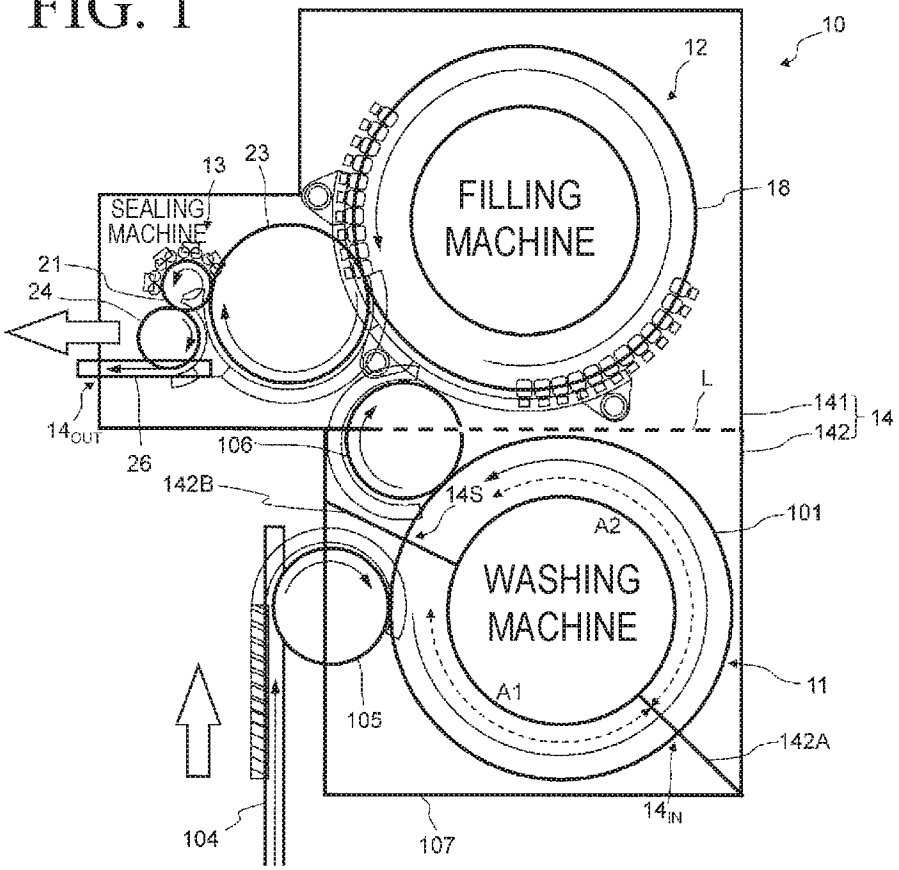
FIG. 1 is a schematic plan view of a gas replacement system according to a first embodiment.
Figure 2:
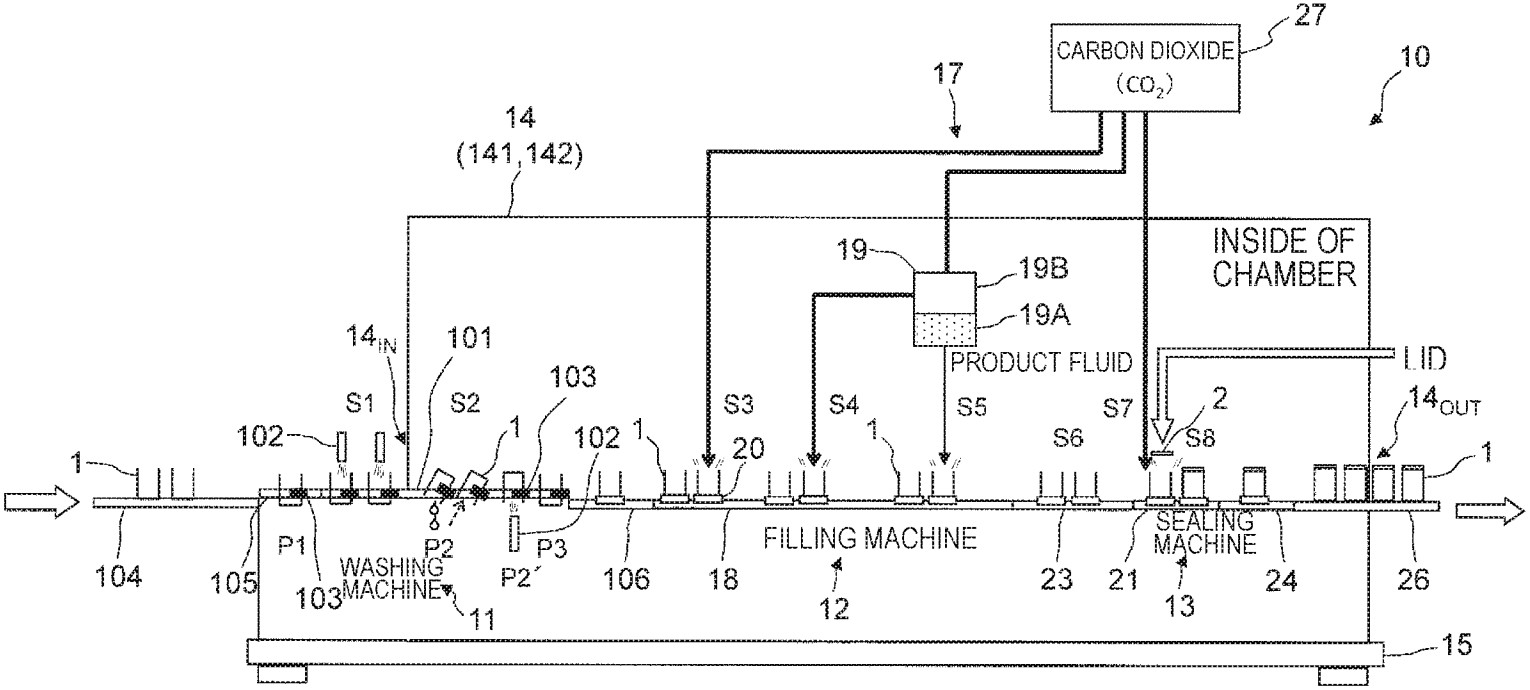
FIG. 2 is a schematic side view of the gas replacement system in FIG. 1.

A gas replacement system 10 shown in FIGS. 1 and 2 fills a container 1 with a content fluid and seals the container 1 while conveying the container 1 (FIG. 2).

The gas replacement system 10 includes a washing machine 11 (rinser), a filling machine 12 (filler), a sealing machine 13 (seamer), a chamber 14 that covers the filling machine 12 and the sealing machine 13, and a gassing system 17 that introduces a replacement gas into the container 1.

In this embodiment, the replacement gas is efficiently introduced into the container 1 in filling the container 1 with a liquid and sealing the filled container 1. To this end, in the gas replacement system 10 according to this embodiment, the chamber 14 covers the filling machine 12 and the sealing machine 13, and water in the container 1 having been carried into the chamber 14 while containing the water as the liquid is discharged in the chamber 14.

The water is introduced into the container 1 before the container 1 is carried into the chamber 14. In this embodiment, the washing machine 11 provided upstream of the filling machine 12 is used to introduce the water into the container 1.

The chamber 14 covers the filling machine 12 and the sealing machine 13 and also covers a predetermined region of the washing machine 11. The chamber 14 contains a continuous space across the predetermined region of the washing machine 11, the filling machine 12, and the sealing machine 13.

The space inside the chamber 14 is referred to as the inside of the chamber 14. A transparent window may be provided in a part of the chamber 14 so as to be able to observe the inside of the chamber 14.

The chamber 14 includes a partial chamber 141 that covers the filling machine 12 and the sealing machine 13, and a partial chamber 142 that covers the predetermined region of the washing machine 11. The insides of the partial chambers 141, 142 communicate with each other.

Although FIG. 1 shows a border L between the partial chamber 141 and the partial chamber 142 by a dashed line for convenience, there is no need for a wall or the like provided along the border L.

First, a configuration of the washing machine 11 will be described.

As shown in FIGS. 1 and 2, the washing machine 11 (rotary rinser) includes a rotor 101, and a nozzle 102 (FIG. 2) that discharges water toward the container 1 held by the rotor 101.

The rotor 101 is rotated by a drive unit (not shown).

The rotor 101 includes grippers 103 (FIG. 2) provided on an outer periphery at a certain pitch. Each of the grippers 103 grips the container 1.

The gripper 103 can rotate around a shaft (not shown) to change a position of the container 1 between an erect position and an inverted position.

In a conveying path of the container 1 in the rotor 101, an upstream section A1 is open to the atmosphere, and a downstream section A2 from the section A1 is covered with the partial chamber 142.

Along with rotation of the rotor 101, the container 1 is carried into the chamber 14 through an inlet 14IN formed in the partial chamber 142.

In the section A1 (hereinafter, a water feed section), the nozzle 102 feeds water into the container 1. In the section A2 (hereinafter, a water discharge section), the water in the container 1 is discharged out of the container 1.

In this embodiment, the conveying path of the rotor 101 is divided into the water feed section A1 and the water discharge section A2 at any ratio between the sections A1, A2.

The division into the water feed section A1 and the water discharge section A2 is made in terms of water feed and water discharge of the container 1, but the container 1 may be washed irrespective of the division. For example, nozzles 102 may be arranged in both the sections A1, A2 to wash the container 1 with water discharged from the nozzles 102.

A conveying device of the washing machine 11 includes a supply conveyor 104 that supplies the container 1 supplied from a pallet of the container (not shown) into the washing machine 11, an inlet star wheel 105 that receives the container 1 from the supply conveyor 104, the rotor 101 described above that receives the container 1 from the inlet star wheel 105, and a star wheel 106 that receives the container 1 from the rotor 101 and transfers the container 1 to the rotor 18 of the filling machine 12.

Such a configuration of the conveying device is a mere example, and the number and arrangement of star wheels may be determined as appropriate.

The conveying device of the washing machine 11 is supported by a base 107 provided on a floor of a building.

In this embodiment, a wall 142A of the partial chamber 142 is provided along a diametrical direction of the rotor 101, and a semicircular region in a plan view of the rotor 101 is covered with the partial chamber 142. Thus, in a middle of the conveying path in the rotor 101, the water feed section A1 and the water discharge section A2 are switched.

However, depending on the configuration of the conveying device of the washing machine 11, the entire star wheel on the downstream side of the two continuous star wheels may be covered with the partial chamber 142, and the water feed section A1 and the water discharge section A2 may be switched at a position where the container 1 is transferred from the star wheel on the upstream side to the star wheel on the downstream side.

The nozzle 102 (FIG. 2) jets water supplied from a water supply source (not shown) toward the container 1 gripped by the gripper 103.

The inside, and outside of the container 1 is washed with the water jetted from the nozzle 102. For more sufficient washing of the container 1, nozzles 102 may be arranged on both upper and lower sides of the container 1.

The water used for washing is not necessarily pure water, butt may contain bactericide at a low concentration. In this embodiment, general tap water is used.

The water having been jetted from the nozzle 102 and washed the container 1 can be collected through trough or the like provided below the rotor 101. The same applies to the water discharged from the container 1.

The nozzle 102 is arranged at least in the water feed section A1 of the water feed section A1 and the water discharge section A2, and also functions as a water supply system (liquid supply system) that introduces water into the container 1.

The nozzle 102 introduces water into the container 1 before the container 1 is carried into the water discharge section A2 in the partial chamber 142 along with the rotation of the rotor 101.

In the water feed section A1, the water jetted downward from the nozzle 102 is supplied into the container 1 under its own weight from the opening 1A of the container 1. It is preferable that an amount of water jetted from the nozzle 102 is appropriately determined so that the water jetted from the nozzle 102 can be efficiently stored in the container 1.

In this embodiment, water is introduced into the container 1 in an erect state (P1), and the position of the container 1 carried into the chamber 14 while containing the water is changed into an inverted state (P2), thereby discharging the water in the container 1.

The container 1 in this embodiment is a can. Changing the position changes an orientation of an opening 1A (FIG. 4) of the container 1.

As shown in FIG. 2, in the water feed section A1, the gripper 103 grips the container 1 in the erect state P1 with the opening 1A upward, and the nozzle 102 introduces water into the container 1.

When the container 1 is carried into the chamber 14 (water discharge section A2) with the opening 1A upward, the gripper 103 rotates to change the container 1 into the inverted state (P2). Then, the water in the container 1 is discharged from the opening 1A under its own weight. Specifically, the gripper 103 also functions as a water discharge mechanism (liquid discharge mechanism) that discharges the water in the container 1.

After the discharge of the water, typically, with the gripper 103 holding the container 1 in the inverted position (P2'), the water is jetted upward by the nozzle 102 from below the container 1 to wash the container 1. This washing may be omitted.

The "erect state" herein refers to a state in which the opening 1A is directed straight upward, and also a state in which the opening 1A is directed generally upward.

The "inverted state" herein refers to a state in which the opening 1A is directed straight downward, and also a state in which the opening 1A is directed generally downward.

Next, configurations of the filling machine 12 and the sealing machine 13 will be described.

The filling machine 12 includes a rotor 18, and a filling nozzle (not shown) that fills the container 1 held by the rotor 18 with a content fluid. The filling nozzle is connected to a liquid phase portion 19A in which the content fluid is stored in a filler bowl 19.

The container 1 is held in the erect position with the opening 1A upward in a pocket 20 (FIG. 2) provided on an outer periphery of the rotor 18 at a certain pitch. The rotor 18 is rotated by a drive unit (not shown).

The sealing machine 13 is a rotary conveying device including a lifter 21, and a lid 2 (FIG. 2) is seamed to the container 1 held by the lifter 21 to seal the container 1.

The conveying device of the gas replacement system 10 includes the rotor 18 and the lifter 21 described above, a transfer star wheel 23 that receives the container 1 from the filling machine 12 and transfers the container 1 to the sealing machine 13, and a discharge star wheel 24 that discharges the container 1 from the sealing machine 13.

Such a configuration of the conveying device is a mere example, and the number and arrangement of star wheels may be determined as appropriate.

Each star wheel that constitutes the conveying device has an appropriate diameter so as to meet a predetermined processing capacity of filling and sealing and prevent the content fluid from spilling out of the opening of the container 1 by a centrifugal force.

The conveying device of the gas replacement system 10 is supported by a common base 15 (FIG. 2), and the entire gas replacement system 10 is integrally configured. The base 15 is provided on the floor of the building.

The partial chamber 141 that covers the filling machine 12 and the sealing machine 13 is formed into a box shape so as to cover the entire conveying device (the rotor 18, the star wheels 23, 24, the lifter 21) of the gas replacement system 10 arranged together on the base 15, and provided on the base 15.

As described above, the container 1 is carried into the partial chamber 142 with the water introduced in the water feed section A1 of the washing machine 11 being stored in the container 1.

Then, the star wheel 106 that transfers the container 1 from the washing machine 11 to the filling machine 12 carries the container 1 from the partial chamber 142 into the partial chamber 141.

The container 1 having been filled and sealed while being conveyed by the rotor 18, the lifter 21, or the like in the partial chamber 141 is discharged out of the partial chamber 141 by the discharge conveyor 26.

The discharge conveyor 26 extends through inside and outside the partial chamber 141 through an outlet 14OUT formed in the partial chamber 141. The container 1 held on the discharge conveyor 26 passes through the outlet 14OUT, and is then transferred to a post-process such as testing, labeling, or packaging.

The chamber 14 has three openings: the inlet 14IN that receives the container 1, the outlet 14OUT from which the container 1 is discharged, and a lid supply port for carrying the 2 into the partial chamber 141. The chamber 14 is sealed except for these openings.

In order to increase a degree of sealing in the chamber 14, the opening in the chamber 14 may be closed by a flow of a liquid (for example, water) or a gas (for example, air, a replacement gas such as a carbon dioxide gas, a gas in the chamber 14).

Figure 3:
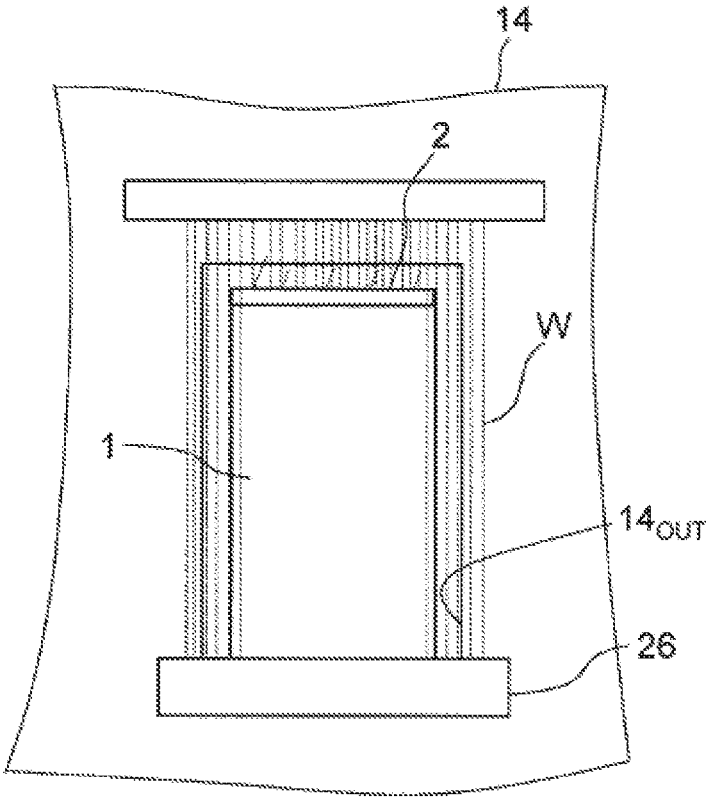
FIG. 3 shows an outlet for discharging a container out of a chamber.

For example, the outlet 14OUT in the chamber 14 shown in FIG. 3 is closed by a curtain-like flow of water W. The water W continuously discharged downward from a discharge port located above the container 1 forms the flow of water W along a surface orthogonal to a conveying direction of the container 1 over the entire region of the outlet 14OUT. The water W is discharged downward from a plurality of discharge ports arranged in a width direction of the conveyor 25 at intervals, or a slit extending along the width direction. The width direction of the conveyor 25 matches a lateral direction in FIG. 3.

At the outlet 14OUT, the opening of the container 1 is sealed so that the water does not flow into the container 1.

Similarly to that shown in FIG. 3, a curtain-like airflow may close the outlet 14OUT.

The inlet 14IN provided in the wall 142A of the partial chamber 142 may be closed by the curtain-like airflow or a curtain-like flow of water W.

In this embodiment, an opening portion 14S (not shown) through which the container 1 passes is provided in a wall 142B that partitions the partial chamber 142 as in the wall 142A. The opening portion 14S is also preferably closed by an airflow or a flow of water like the inlet 14IN.

If the container 1 is filled with the content fluid with air existing in the container 1, an oxygen gas contained in the air in the container 1 is mixed in the content fluid, and quality of the content fluid may be impaired by the content fluid coming into contact with the oxygen gas. The same applies when the container 1 is sealed with the air remaining in a head space 1H (FIG. 4) above a fluid level, because the oxygen gas comes into contact with the content fluid.

Thus, it is effective that in filling and sealing, the gassing system 17 replaces the air in the container 1 with a gas replacement gas inactive to the content fluid, and remove the oxygen gas in the container 1 to a predetermined concentration or less. In particular, if the content fluid is a beer beverage such as beer or law mist beer, the oxygen gas tends to impair quality, and there is a strong request to reduce the concentration of the oxygen gas in the container 1.

A carbon dioxide gas ($CO_2$) is typically used as the replacement gas, but a nitrogen gas ($N_2$) or water vapor ($H_2O$) may be used.

As specific examples, the air in the head space is replaced with the nitrogen gas for preventing oxidation of a non-gas beverage, or the air is replaced with water vapor or a mixture of the nitrogen gas and the water vapor when a can container is filled with a non-gas beverage.

In this embodiment, the carbon dioxide gas is used as the replacement gas.

As shown in FIG. 2, the gas replacement system 10 includes a tank 27 filled with a liquid-phase carbon dioxide, that is, a liquefied carbon dioxide gas as a supply source of the carbon dioxide gas. The carbon dioxide gas supplied from the tank 27 through the filler bowl 19 is blown into the container 1 by the gassing system 17. The tank 27 is connected to a gas-phase portion 19B in the filler bowl 19, and the liquefied carbon dioxide gas turns into a gas-phase carbon dioxide gas when being introduced into the gas-phase portion 19B.

The gassing system 17 (FIG. 2) includes a blowing nozzle that blows the carbon dioxide gas supplied from the tank 27, and a valve that opens/closes a flow path of the blowing nozzle. The nozzle and the valve are not shown. The nozzle and the valve may be provided integrally with a filling nozzle of the filling machine 12.

For a content fluid containing a carbon dioxide gas such as beer, a counter process for pressurizing the inside of the container 1 when filling, and a snifting process for discharging air to reduce pressure in the container 1 when drawing the filling nozzle out of the liquid are performed. Paths and valves required for these processes may be provided integrally with the filling nozzle.

In this embodiment, in the filling machine 12, the gassing system 17 sequentially performs non-seal gassing and seal gassing. The non-seal gassing is performed without the opening of the container 1 being closed, and the seal gassing is performed with the opening of the container 1 being closed by the filling nozzle of the filling machine 12.

The non-seal gassing rapidly reduces the concentration of the oxygen gas in the container 1, and then the seal gassing more sufficiently reduces the concentration of the oxygen gas in the container 1, thereby allowing the contents of the container 1 to be efficiently replaced with the carbon dioxide gas.

Further, in the sealing machine 13, undercover gassing is performed for blowing the carbon dioxide gas between the lid 2 and the container 1 and replacing the gas in the head space 1H in the container 1 with the carbon dioxide gas.

The non-seal gassing, the seal gassing, and the undercover gassing may be selectively performed by the gassing system 17 depending on types of the fluid.

A configuration of piping of the gassing system 17 may be determined as appropriate.

The carbon dioxide gas introduced into the container 1 by the gassing system 17 leaks from the container 1, for example, while the container 1 is transferred from the filling machine 12 to the sealing machine 13. Since the leaking carbon dioxide gas remains in the chamber 14, an ambient gas in the chamber 14 contains a higher concentration of carbon dioxide gas than the atmosphere. The concentration increases with increasing duration of an operation of the gas replacement system 10.

The gas replacement system 10 according to this embodiment has a main feature that the container 1 containing water is carried into the chamber 14, the water in the container 1 is discharged in the chamber 14, and thus the contents of the container 1 are replaced with the ambient gas in the chamber 14 containing a higher concentration of carbon dioxide gas than the atmosphere.

Further, in this embodiment, gassing by the gassing system 17 is performed in the chamber 14 after the discharge of the water in the container 1.

Even if non-seal gassing is performed for a remaining space in the container 1 with the container 1 containing the water, the carbon dioxide gas blown into the container 1 at that time is forced out of the container 1 by the water during the discharge of the water, the contents of the container 1 are replaced with the ambient gas in the chamber 14 to reduce the concentration of the carbon dioxide gas in the container 1. Thus, there is no point in gassing.

The water in the container 1 cannot be discharged after the filling nozzle seals the opening 1A of the container 1. However, the water in the container 1 needs to be discharged before the container 1 is filled with the content fluid so that the water is not mixed in the content fluid.

From the above, the water in the container 1 carried into the chamber 14 is discharged before a first process (in this embodiment, non-seal gassing) by the gassing system 17.

If the water in the container 1 is discharged in the chamber 14, the ambient gas containing the carbon dioxide gas having leaked from the container 1 and remaining in the chamber 14 is introduced into the container 1 before the carbon dioxide gas is introduced by the gassing system 17.

Next, with reference to FIGS. 2 and 4, a series of processes by the washing machine 11, the filling machine 12, and the sealing machine 13 will be described.

Figure 4:
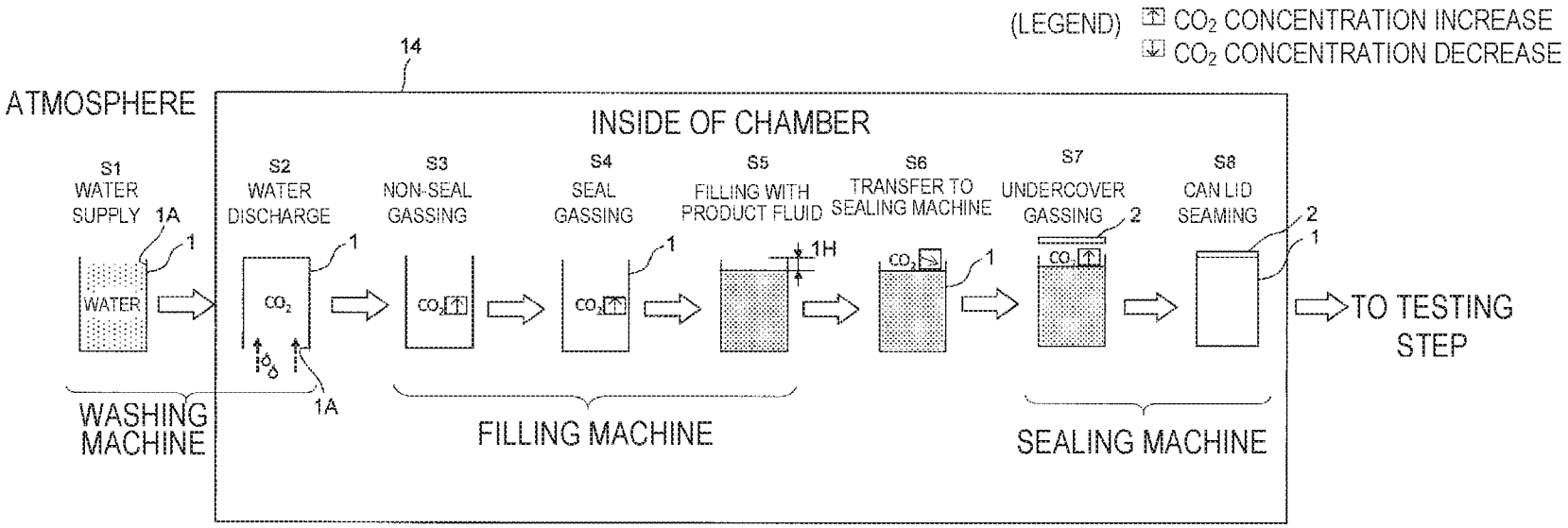
FIG. 4 shows processing steps of replacement, filling, and sealing.

As a legend in FIG. 4, arrows enclosed by squares conceptually show how each process changes the concentration of the carbon dioxide gas in the container 1.

The container 1 supplied to the washing machine 11 starts to be washed with water jetted from the nozzle 102 while being gripped in the erect state P1 by the gripper 103, and simultaneously, water is supplied from the nozzle 102 into the container 1 until the container 1 is full of water (step S1: water supply). The container 1 is carried into the chamber 14 while being in a full water state, and the position of the container 1 is changed into the inverted state P2 in the chamber 14 along with the rotation of the gripper 103 to discharge the water (step S2: water discharge).

Then, the water in the container 1 is replaced with the ambient gas in the chamber 14. The carbon dioxide gas ($CO_2$) contained in the ambient gas is introduced into the container 1 (see dashed arrows in FIG. 4).

In preparation for filling with the content fluid performed thereafter, the gripper 103 is used to return the position of the container 1 to an erect state P3. The ambient gas in the chamber 14 contains a gas other than the carbon dioxide gas, for example, oxygen, butt continuing the operation of the gas replacement system 10 gradually increases the concentration of the carbon dioxide gas.

As described above, in this embodiment, the container 1 in the full water state is carried into the chamber 14 filled with the ambient gas containing a higher concentration of carbon dioxide gas than the atmosphere, and the water is discharged in the chamber 14 to replace the contents of the container 1 with the ambient gas contained in the chamber 14.

If the container 1 containing no water and filled with the atmosphere is carried into the chamber 14, the atmosphere in the container 1 is also brought into the chamber 14 together with the container 1. However, according to this embodiment in which the container 1 filled with water is carried, an amount of the atmosphere, that is, oxygen brought into the chamber 14 as the container 1 is carried can be significantly reduced, thereby preventing a reduction in the concentration of the carbon dioxide gas in the chamber 14.

Thus, according to this embodiment, the contents of the container 1 can be efficiently replaced with the carbon dioxide gas in the chamber 14 while keeping the concentration of the carbon dioxide gas in the chamber 14.

Next, the filling machine 12 performs a process described below.

Descriptions on a counter process and a sniffing process performed when the content fluid contains the carbon dioxide gas will be omitted.

The gassing system 17 blows the carbon dioxide gas as the replacement gas supplied from the tank 27 into the container 1 without the opening being closed, the container 1 being held by the filling machine 12 (step S3: non-seal gassing). A flow of the carbon dioxide gas blown causes the gas in the container 1 to leak from the opening of the container 1, and also causes a part of the carbon dioxide gas blown to leak from the opening of the container 1.

The non-seal gassing rapidly replaces the gas in the container 1 with the carbon dioxide gas to increase the concentration of the carbon dioxide gas in the container 1.

Then, the opening of the container 1 is closed by the filling nozzle to ensure a degassing path in the filling nozzle, and the gassing system 17 blows the carbon dioxide gas into the container 1 (step S4: seal gassing). The degassing path is open into the chamber 14.

The seal gassing further advances the replacement of the gas in the container 1 with the carbon dioxide gas, and the oxygen gas in the container 1 is more sufficiently removed.

The container 1 from which the oxygen gas is removed by the above is filled with the content fluid by the filling nozzle (step S5: filling with the content fluid).

At this time, when the container 1 is filled with the content fluid, the carbon dioxide gas of a volume equivalent to a volume of the content fluid returns to the gas-phase portion 19B in the filler bow 19, but the carbon dioxide gas by an amount for snifting in the head space 1H leaks through the degassing path in the filling nozzle into the chamber 14. Thus, the carbon dioxide gas in the container 1 is replaced with the content fluid.

The container 1 filled with the content fluid is transferred from the rotor 18 of the filling machine 12 via the transfer star wheel 23 to the lifter 21 of the sealing machine 13 (step S6: transfer to the sealing machine).

If the carbon dioxide gas in the head space 1H in the container 1 leaks from the opening of the container 1 while the container 1 is transferred from the filling machine 12 to the sealing machine 13, the carbon dioxide gas in the head space 1H by an amount for leakage is replaced with the ambient gas in the chamber 14. The example in FIG. 4 shows that the leakage during the transfer somewhat reduces the concentration of the carbon dioxide gas in the container 1. The ambient gas contains a higher concentration of carbon dioxide gas than the atmosphere.

Due to the carbon dioxide gas leaking from the container 1, the chamber 14 contains a higher concentration of carbon dioxide gas than the atmosphere, thereby preventing a reduction in the concentration of the carbon dioxide gas in the head space 1H caused by the leakage from the container 1. Thus, the container 1 is supplied to the sealing machine 13 with the concentration of the carbon dioxide gas remaining in the container 1.

The sealing machine 13 performs a process described below.

The lid 2 supplied into the chamber 14 is placed to face the opening of the container 1, and the gassing system 17 blows the carbon dioxide gas into a gap between the lid 2 and the container 1 (step S7: undercover gassing). Then, the flow of the carbon dioxide gas blows away the gas in the head space 1H, which is replaced with the carbon dioxide gas.

Immediately after the undercover gassing or during the undercover gassing, double seaming of the lid 2 to the container 1 lifted by the Lifter 21 is performed to seal the container 1 (step S8: seaming).

In the processes of filling and sealing described above, the carbon dioxide gas supplied from the tank 27 and once introduced into the container 1 by the gassing system 17 leaks into the chamber 14 around the container 1.

The carbon dioxide gas leaking into the chamber 14 includes, for example, an excess of the carbon dioxide gas blown into the container 1 and flowing out of the container 1 in the non-seal gassing (step S3), or a gas discharged from the degassing path in the seal gassing (step S4).

The carbon dioxide gas introduced into the container 1 by the non-seal gassing and the seal gassing leaks into the chamber 14 in the snifting process in filling (step S5) or the transfer (step S6). Then, in the undercover gassing (step S7), much of the carbon dioxide gas blown leaks into the chamber 14.

Specifically, a region containing a high concentration of carbon dioxide gas is formed around the conveying path of the container 1 in the gas replacement system 10, and the carbon dioxide gas remains in the chamber 14.

In this embodiment, the ambient gas containing the carbon dioxide gas having leaked from the container 1 and remaining in the chamber 14 is introduced into the container 1 as the water in the container 1 is discharged in the chamber 14 (step S2). Thus, the container 1 contains a higher concentration of carbon dioxide gas than the atmosphere, and accordingly, by an increment of the concentration of the carbon dioxide gas, an amount of the carbon dioxide gas supplied from the tank 27 can be reduced in next steps S3 and S4 of gassing. Specifically, in steps S3 and S4, a carbon dioxide gas by an amount for a shortage for obtaining the predetermined concentration of the carbon dioxide gas in the container 1 may be introduced into the container 1.

Even if a part of the carbon dioxide gas in the head space 1H in the container 1 is replaced with the ambient gas in the chamber 14 when the container 1 is transferred from the filling machine 12 to the sealing machine 13, the concentration of the carbon dioxide gas in the chamber 14 is higher than in the atmosphere, and thus the concentration of the carbon dioxide gas is high in the head space 1H. By an increment of the concentration of the carbon dioxide gas, the amount of use of the carbon dioxide gas by the gassing system 17 can be reduced in step S7 of the undercover gassing.

According to this embodiment, almost ail of the carbon dioxide gas having leaked from the container 1 remains in the chamber 14, the water in the container 1 carried into the chamber 14 while containing the water is discharged, and then the processing by the gassing system 17 is performed. Thus, according to this embodiment, the amount of use of the carbon dioxide gas supplied from the tank 27 can be significantly reduced, and also the contents of the container 1 can be efficiently replaced to sufficiently reduce the concentration of the oxygen gas in the space and the content fluid in the container 1. The reduction in the amount of use of the carbon dioxide gas can reduce manufacturing cost, and contribute to safety in working environment and protection of natural environment.

Also, the gassing system 17 blows the gas in the chamber 14 substantially sealed, and thus the inside of the chamber 14 is at positive pressure with respect to the outside of the chamber 14 under the atmospheric pressure, thereby preventing foreign matters such as dust or insects from entering the chamber 14 from outside.

Thus, there is no need to prepare a room with an adequate hygiene level for providing the gas replacement system 10, thereby reducing capital investment and providing high flexibility in changing a device configuration of a manufacturing line.

The chamber 14 may cover only the conveying path of the container 1 and therearound in the processes from the discharge of the water in the container 1 through the processing by the gassing system 17 to the sealing of the container 1.

In this embodiment, the position where the water in the container 1 is discharged by the gripper 103 in the washing machine 11 is included in the region covered with the chamber 14.

The gripper 103 as the water discharge mechanism may be included in the rotor of the filling machine 12. In that case, the chamber 14 may cover only the filling machine 12 and the sealing machine 13.

Figure 5:
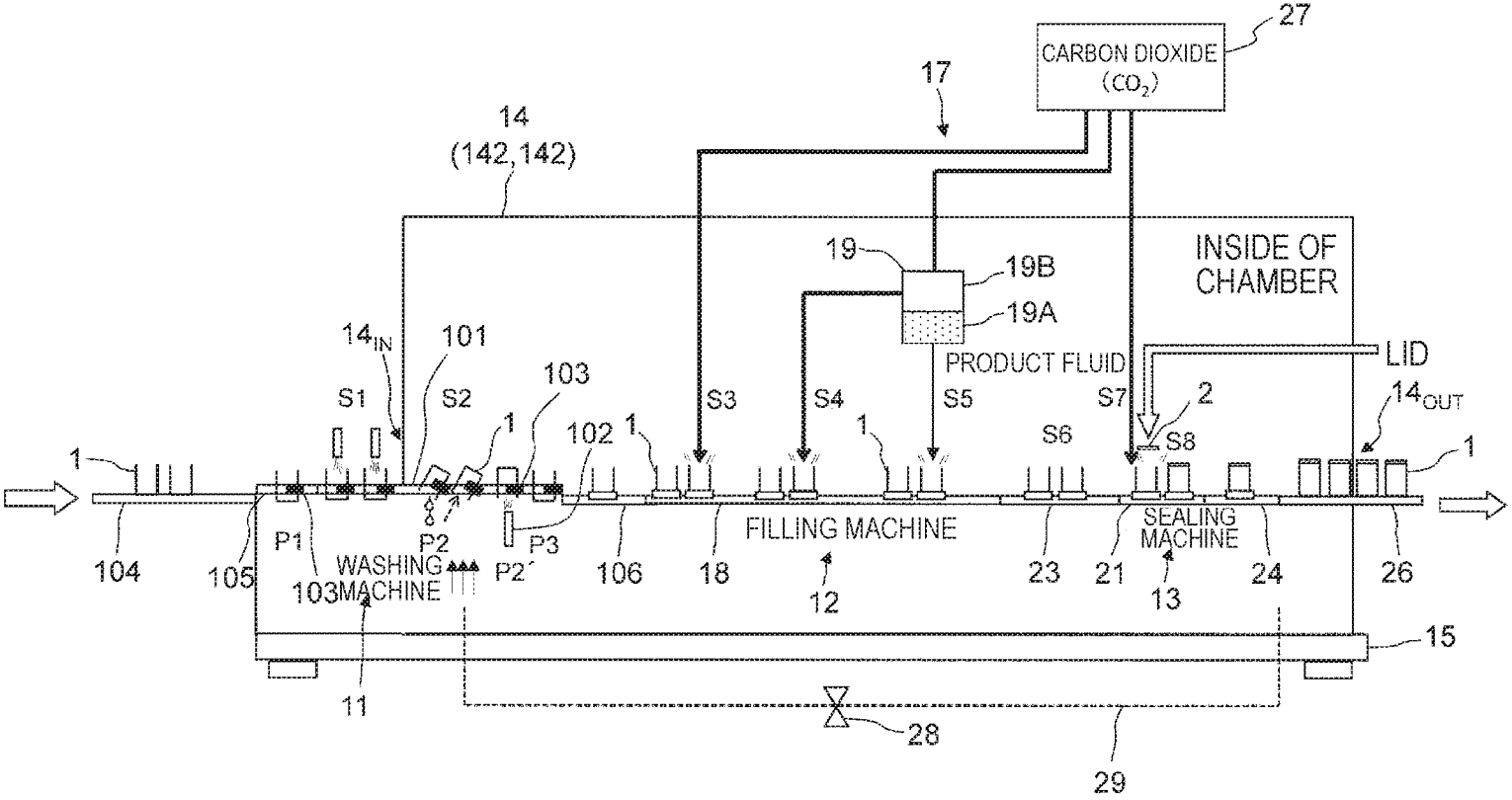
FIG. 5 is a schematic side view of a gas replacement system according to a variant of the first embodiment.

If there is a gradient of the concentration of the carbon dioxide gas in the chamber 14, for example, as shown in FIG. 5, a gas containing a relatively high concentration of carbon dioxide gas in the chamber 14 is preferably sucked by a blower 28 into a flow path 29 and supplied near the position where the water in the container 1 is discharged. This can increase a rate of replacement of the contents of the container 1 with the carbon dioxide gas.

Alternatively, without using the blower 28, the chamber 14 may be partitioned by a wall, and by a difference in pressure between opposite sides of the wall, the gas containing a high concentration of carbon dioxide gas may be supplied near the position where the water in the container 1 is discharged. The wall may be provided, for example, in the position of the border L in FIG. 1. Pressure on a downstream side of the wall is relatively high due to leakage of the carbon dioxide gas from the container 1, and pressure on an upstream side of the wall is relatively low. Thus, through an appropriate path that provides communication between the opposite sides of the wall, the gas containing a high concentration of carbon dioxide gas can be efficiently fed into the container 1 before the gassing.

Second Embodiment

Figure 6:
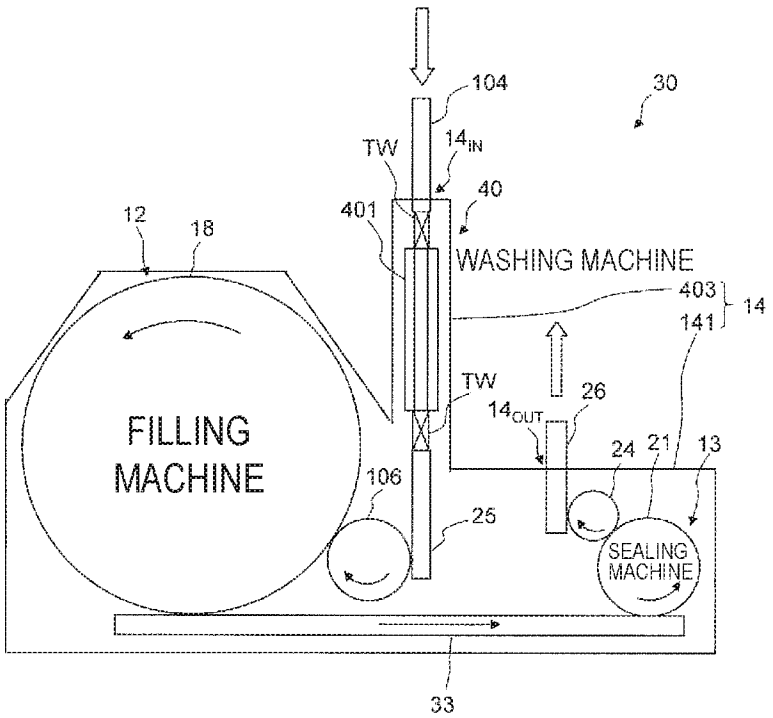
FIG. 6 is a schematic plan view of a gas replacement system according to a second embodiment.
Figure 7:
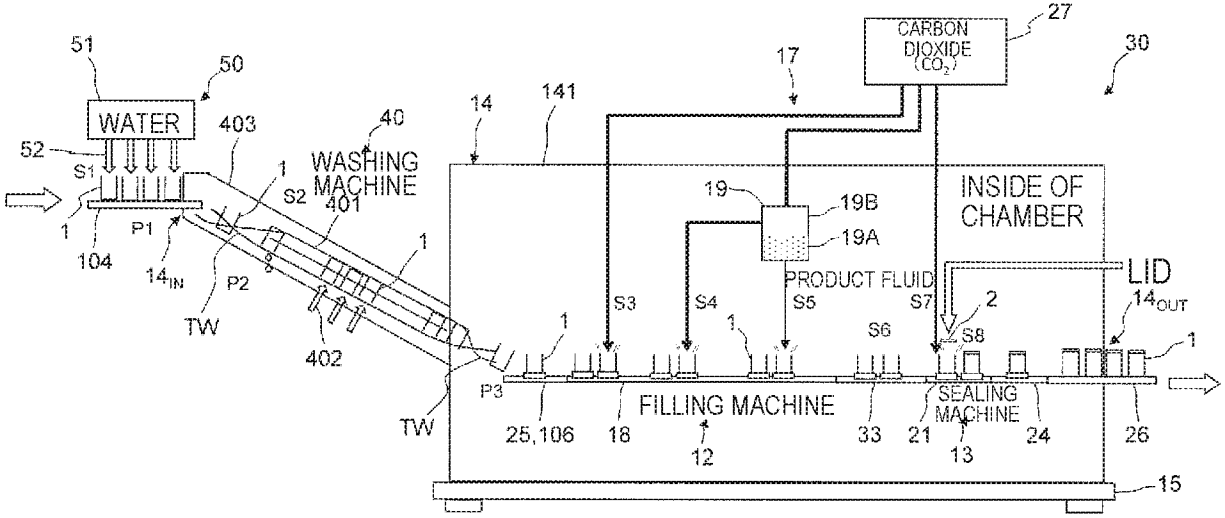
FIG. 7 is a schematic side view of the gas replacement system in FIG. 6.

Next, with reference to FIGS. 6 and 7, a second embodiment of the present invention will be described.

Differences from the first embodiment will be mainly described below. The same configurations as in the first embodiment are denoted by the same reference numerals.

In the second embodiment, the container 1 containing water is supplied to a washing machine 40 (roll-through rinser) to discharge water.

A gas replacement system 30 according to the second embodiment includes a water supply system 50 (FIG. 7), the washing machine 40, the filling machine 12, the sealing machine 13, the chamber 14, and the gassing system 17.

The water supply system 50 includes a water supply source 51, and a water supply nozzle 52 that feeds water supplied from the water supply source 51 into the container 1.

A transfer conveyor 33 transfers the container 1 from the filling machine 12 to the sealing machine 13.

The washing machine 40 includes a frame 401 (a conveying path of the container) constituted by a plurality of metal guide bars (round bars), and a nozzle 402 (FIG. 7) that jets water, and showers the container 1 with water from the nozzle 402 while rolling the container 1 under its own weight in the frame 401.

The guide bars that constitute the frame 401 extend gradually downward from top to bottom.

The frame 401 includes a twist section TW where the guide bars are twisted. The container 1 runs through the twist section TW, and thus a position of the container 1 is inverted.

The twist sections TW are arranged on upstream and downstream sides, respectively, of the frame 401.

A region from the upstream twist section TW to the downstream twist section TW is covered with a washing chamber 403.

An inside of the washing chamber 403 communicates with an inside of the partial chamber 141 that covers the filling machine 12 and the sealing machine 13. In this embodiment, the washing chamber 403 and the partial chamber 141 constitute the chamber 14 that contains a continuous space. In this embodiment, the inlet 14IN that receives the container 1 into the chamber 14 is provided in the washing chamber 403.

The chamber 14 may be constituted by appropriately divided parts. For example, the washing chamber 403, a partial chamber that covers the rotor 18 and the star wheel 106 of the filling machine 12, a partial chamber that covers the transfer conveyor 33, and a partial chamber that covers the lifter 21 and the discharge star wheel 24 of the sealing machine 13 may constitute the chamber 14.

The container 1 is supplied with water into a full water state by the water supply nozzle 52 of the water supply system 50 while being conveyed in the erect state P1 by the supply conveyor 104 (step S1: water supply).

Then, the container 1 is carried into the chamber 14 (into the washing chamber 403), and brought into the inverted state P2 in the upstream twist section TW. Water is discharged from the container 1 in the inverted state P2 (step S2: water discharge).

Specifically, the upstream twist section TW functions as a water discharge mechanism. In order to discharge water in the container 1 having a larger opening 1A than a bottle or the like, the container 1 need only be tipped over sideways rather than be inverted.

Along with the discharge of the water from the container 1, the contents of the container 1 is replaced with the ambient gas in the chamber 14 containing the carbon dioxide gas.

The container 1 still in the inverted state is washed with water jetted from the nozzle 402 while rolling down in the frame 401. At this time, even if the washing water enters the container 1, the washing water is immediately discharged under its own weight. The nozzles 402 may be arranged on both a side of the opening 1A and a bottom side of the container 1.

The container 1 is returned to the erect state P3 in the downstream twist section TW, and then transferred to the conveyor 25 that conveys the container 1 toward the filling machine 12.

Thereafter, the same processes as the processes (S3 to S8) in the first embodiment (FIG. 4) are performed.

According to the second embodiment, like the first embodiment, almost all of the carbon dioxide gas having leaked from the container 1 remains in the chamber 14, the water in the container 1 carried into the chamber 14 while containing the water is discharged, and then the processing by the gassing system 17 is performed. Thus, according to the second embodiment, the amount of use of the carbon dioxide gas can be significantly reduced, and also the contents of the container 1 can be efficiently replaced to sufficiently reduce the concentration of the oxygen gas in the space and the content fluid in the container 1.

Supplying water into the container 1 and discharging the water in the container 1 to introduce the ambient gas in the chamber 14 into the container 1 is performed on the condition that the concentration of the carbon dioxide gas in the chamber 14 is higher than in the atmosphere.

Thus, if the chamber 14 is filled with the atmosphere at the beginning of the operation of the filling machine 12 and the sealing machine 13, the water supply into the container 1 by the water supply system 50 is preferably started after the gas in the chamber 14 reaches a predetermined concentration of the carbon dioxide gas.

Also, at the beginning of the operation, the carbon dioxide gas may be previously introduced into the chamber 14 so that the concentration of the carbon dioxide gas in the chamber 14 is higher than in the atmosphere, and the water supply into the container 1 may be performed from the beginning of the operation.

In the second embodiment, the container 1 may be washed by the water supply into the container 1 and the water discharge from the container 1, and the washing step of showering the container 1 while rolling in the frame 401 with the water from the nozzle 402 may be omitted.

In this case, only the frame 401 of the washing machine 40 may be used as the conveying path, and the nozzle 402 may not be used.

Also, an intermediate section between the upstream twist section TW and the downstream twist section TW of the frame 401 may be eliminated so that the upstream twist section TW directly connects to the downstream twist section TW.

Alternatively, a roll-through type washing machine as in the second embodiment may be used for washing the container 1 and also supplying water into the container 1 like the washing machine 11 in the first embodiment, and the water supply system 50 that feeds the water into the container 1 may be eliminated.

In that case, the twist section TW and the nozzle 402 are arranged in appropriate positions so that the water can be supplied from the nozzle 402 into the container 1 in the erect state. Then, a position where the water is supplied into the container 1 is open to the atmosphere without being covered with the chamber 14, and after the container 1 containing the water is carried into the chamber 14, the water is discharged in the twist section TW in the chamber 14.

Even if the container 1 is not in the full water state when carried into the chamber 14, the contents of the container 1 is replaced with the gas containing the carbon dioxide gas in the washing chamber 403 by an amount of the water discharged, thereby contributing a reduction in the amount of use of the carbon dioxide gas.

Third Embodiment

Figure 8:
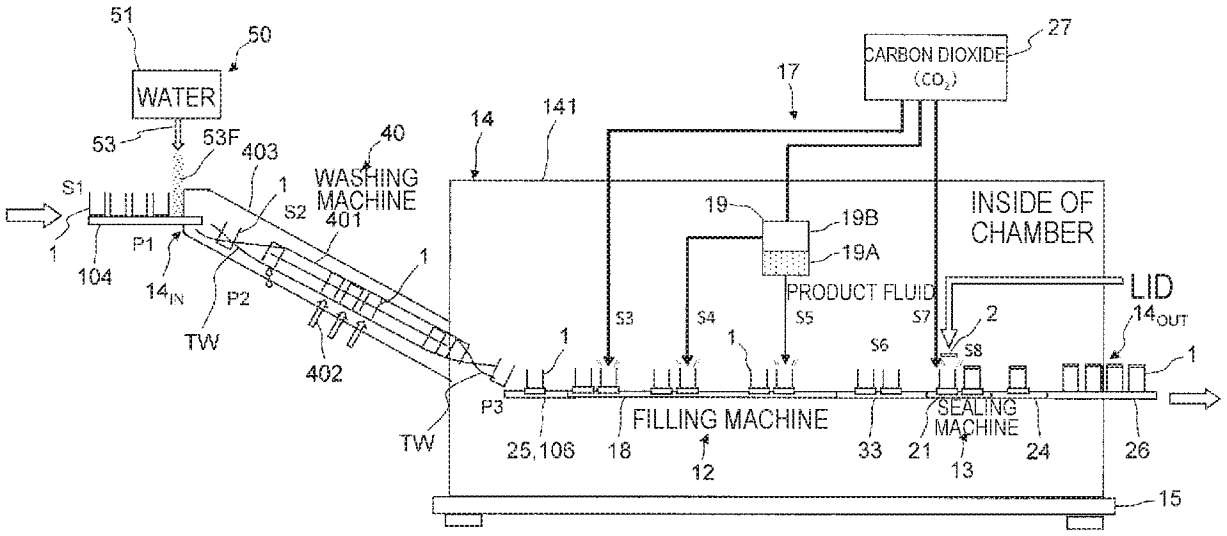
FIG. 8 is a schematic side view of a gas replacement system according to a third embodiment.

Next, with reference to FIG. 8, a third embodiment of the present invention will be described.

In the third embodiment, water is Introduced between the containers 1, 1 at a position where the container 1 is carried into the chamber 14.

The inlet 14IN in the chamber 14 corresponds to the position where the container 1 is carried into the chamber 14.

In this embodiment, water in a curtain shape is discharged from a water supply nozzle 53 provided in the water supply system 50 at a position of the inlet 14IN through which the supply conveyor 104 extends.

A preferable configuration of the water supply nozzle 53 will be described.

A plurality of water supply nozzles 53 are provided. The water supply nozzles 53 include upper nozzles that discharge water from top into the container 1, and lateral nozzles that discharge water in a direction orthogonal to a conveying direction toward a gap between the containers 1 arranged on the supply conveyor 104. The nozzles form a curtain-like flow of water 53F.

When the container 1 passes through the flow of water 53F, the water is introduced from the opening 1A into the container 1 and also introduced between the containers 1 adjacent in the conveying direction (step S1: water supply). Thus, air in the container 1 is replaced with the water, and air between the containers 1, 1 is also replaced with the water. Simply by introducing the water into the container 1, the amount of air entering the chamber 14 can be reduced as compared to the case where an empty container 1 containing no water is carried into the chamber 14. By also introducing the water between the containers 1, 1, the amount of air entering the chamber 14 can be further reduced.

The water introduced into the container 1 is carried into the chamber 14 together with the container 1, and then discharged out of the container 1 by the position of the container 1 being changed into the inverted state P2 in the twist section TW (step S2: water discharge). The water introduced between the containers 1, 1 flows out from between the containers 1, 1 immediately after the container 1 is carried into the chamber 14 because no bank or the like that keeps the water between the containers 1, 1 is provided there.

Thereafter, the same processes as the processes (S3 to S8) in the first embodiment (FIG. 4) are performed.

In the third embodiment, by the flow of water 53F at the inlet 14IN in the chamber 14, not only the air in the container 1 but also the air in the gap between the containers 1, 1 are replaced with the water when the container 1 is carried into the chamber 14. Also, the inlet 14IN in the chamber 14 is closed by the flow of water 53F.

This can prevent the air from entering the chamber 14 as the container 1 is carried into the chamber 14, and prevent the ambient gas in the chamber 14 from leaking from the inlet 14IN out of the chamber 14.

Specifically, a degree of sealing in the chamber 14 is increased, and this allows the ambient gas, in particular, the carbon dioxide in the chamber 14 to be used without any waste, and allows the inside of the chamber 14 to be reliably kept at positive pressure to prevent entry of foreign matters.

As the water supply nozzle 53, only the upper nozzle that discharges water from above the container 1 toward the container 1 may be provided like the water supply nozzle 52 in she second embodiment (FIG. 7), but a combination of the upper nozzle and the lateral nozzle that jets water in the direction orthogonal to the conveying direction allows the water to be more reliably introduced between the containers 1, 1.

The set of nozzles that discharges the water in the curtain shape may be arranged upstream of the inlet 14IN in the chamber 14 in addition to the position of the inlet 14IN.

The water introduced between she containers 1, 1 is not kept between the containers 1, 1 but flows out from between the containers 1, 1. Thus, in order to prevent the atmosphere between the containers 1, 1 from being brought into the chamber 14, the water needs to be introduced between the containers 1, 1 by the nozzle at the position of the inlet 14IN.

The water may be introduced only between the containers 1, 1 at the position of the inlet 14IN, and the water may be introduced only into the container 1 at the position upstream thereof.

The flow of water 53F can be also formed by the water supply nozzle 53 at she position of the inlet 14IN in the partial chamber 142 that covers the predetermined region of the washing machine 11 in the first embodiment. This can provide the same advantage as the third embodiment.

The gas replacement systems according to the first to third embodiments described above all introduces the carbon dioxide gas into the container 1 by the gassing system 17 in the chamber 14, but the processing by the gassing system 17 is not essential in the present invention.

Specifically, the container 1 containing water is carried into the chamber 14 and the water is discharged from the container 1 in the chamber 14. This alone allows the contents of the container 1 to be efficiently replaced with the carbon dioxide gas in the chamber 14 while keeping the concentration of the carbon dioxide gas in the chamber 14.

Thus, the present invention encompasses a configuration in which the gassing system 17 is eliminated from the gas replacement system according to the first to third embodiments.

More specifically, the present invention encompasses a gas replacement system including: a filling machine 12 that fills a container 1 with a content fluid; a sealing machine 13 that seals the container 1 transferred from the filling machine 12; a chamber 14 that covers the filling machine 12 and the sealing machine 13 and contains a replacement gas; and a liquid discharge mechanism that discharges water in the container 1 carried into the chamber 14 while containing the water out of the container 1 in the chamber 14.

In this gas replacement system, for example, the chamber 14 may contain an ambient gas having a higher concentration of $N_2$ gas than the atmosphere, the container 1 containing the water is carried into the chamber 14, and the water is discharged in the chamber 14. Thus, the contents of the container 1 is replaced with the ambient gas in the chamber 14 containing the $N_2$ gas, and then the container 1 can be filled with the content fluid without the gassing.

[Variant of the Present Invention]

The container in the present invention is not limited to a can, but may be a PET bottle or a glass bottle. Such containers are sealed by respective appropriate methods.

The lid for sealing the container, that is, a packaging material for sealing the container 1 includes a can lid, also a bottle cap, or a film that seals an opening portion of a container body.

In the present invention, water is representative of a liquid as a medium in the container 1 to be replaced with the ambient gas in the chamber 14 as the liquid is discharged from the container 1 in the chamber 14, but other liquids may be used. For example, a content fluid having a lower concentration than a defined concentration may be introduced into the container 1 and discharged in the chamber 14.

The gas replacement system and the gas replacement method according to the present invention for introducing the replacement gas into the container 1 for quality preservation of the filled content fluid may be appropriately configured as long as the liquid in the container 1 carried into the chamber 14 while containing the liquid is discharged in the chamber 14 and then gassing is performed.

Such a system may not necessarily include a washing device that washes the container 1, and such a method does not necessarily require a washing step of the container 1.

However, the configuration of the washing machine 11 or 40 provided as an upstream step of the filling machine 12 may be used to easily achieve the liquid discharge mechanism and the liquid supply system in the present invention, and cost of the gas replacement system can be reduced because of a few additional elements.

As the examples of the washing machine, the rotary rinser (first embodiment) and the roll-through rinser (second embodiment) are taken, but besides, a grip rinser or a bottle washing machine, or the like may be used.

The grip rinser includes a conveying path that conveys the container 1 while holding the container 1 from opposite sides by a rubber belt. The conveying path includes a first section and a second section in Which the position of the container is inverted with the container being held by the rubber belt wound around a rotor that rotates around a horizontal axis. In the grip rinser, washing water is fed from a nozzle into the container conveyed in the erect state, and the water in container can be discharged along with the inversion of the container in the first section. Then, the container is again inverted in the second section and returned to the erect state, and discharged toward a filling step.

The bottle washing machine used for a beer bottle or the like washes a container by placing a bottle in bottle gages arranged in a plurality of rows and immersing the bottle gages in a washing liquid. After the washing, rotation of the bottle gage inverts the bottle to discharge the washing liquid in the bottle. Then, the bottle is returned to the erect state and discharged toward the filling step.

Besides, an appropriate washing machine may be used depending on types of the containers.

As described above, the container 1 may be washed by the water supply (water feed) into the container 1 and the water discharge. Thus, the container 1 may be washed at appropriate timing as required.

For example, as in the second embodiment, the water supply system 50 may supply water into the container 1, and then the washing machine 40 may discharge the water while washing the container 1, or the water may be supplied into the container 1 after washing of the container 1 and then discharged. For the latter case, if the washing water remains in the container 1, water may be supplied into a remaining space in the container 1. Specifically, the water stored in the container 1 from the washing step to the water supply step.

Alternatively, the water may be discharged after the water supply into the container 1, and then the container 1 may be washed.

The container 1 needs not be washed in the chamber 14. In the present invention, it is important that the water supplied into the container 1 before the container 1 is carried into the chamber 14 is discharged in the chamber 14.

"Supplying water into the container before the container is carried" encompasses supplying water at the same time as the container 1 is carried into the chamber 14 as in the third embodiment.

According to the present invention, it is not essential to change the position of the container 1 for the water supply and the water discharge. For example, the water in the container 1 conveyed in the erect state by the conveyor may be sucked by a nozzle to be discharged out of the container 1.

Also, in the present invention, it is not essential that the position of the container 1 is the erect state in the water supply. For example, the container 1 may be carried into the chamber 14 while the opening 1A of the container 1 into which the water is introduced in the inverted state is closed by an appropriate member, and the opening 1A may be opened in the chamber 14 to discharge the water in the container 1.

Other than the above, the configurations of the embodiments may be selected or appropriately changed to different configurations without departing from the gist of the present invention.

The content fluid that fills the container 1 may include, not limited to beer or beer beverages, all kinds of alcohol and beverages such as Japanese sake, foreign liquors, coffee beverages, fruit juice beverages, tea beverages. The present invention is applicable to such alcohol and beverages of which oxidation should be avoided.

Also, the liquid filling the container is not limited to beverages, but may be any liquid that needs quality preservation by use of a replacement gas.

REFERENCE SIGNS LIST

1
1A opening
1H head space
10 gas replacement system
11 washing machine
12 filling machine
13 sealing machine
14 chamber
14IN inlet
14OUT outlet
14S opening portion
15 base
17 gassing system
18 rotor
19 filler bowl
19A liquid phase portion
19B gas phase portion
20 pocket
21 lifter
23 transfer star wheel
24 discharge star wheel
25 conveyor
26 discharge conveyor
27 tank (supply source)
28 blower
29 flow path
30 gas replacement system
33 transfer conveyor
40 washing machine
50 water supply system (liquid supply system)
51 water supply source
52 water supply nozzle
53 water supply nozzle
53F flow of water
101 rotor
102 nozzle (liquid supply system)
103 gripper (liquid discharge mechanism)
104 supply conveyor
105 inlet star wheel
106 star wheel
107 base
141 partial chamber
142 partial chamber
142A, 142B wall
401 frame
402 nozzle
403 washing chamber
A1 water feed section
A2 water discharge section
L border
P1 erect state
P2 inverted state
S1 water supply step (first step)
S2 water discharge step (second step)
S3 non-seal gassing step (third step)
S4 seal gassing step (third step)
S5 filling step
S6 transfer step S7 undercover gassing step (third step)
S8 seaming step
TW twist section (liquid discharge mechanism)
W water

The invention claimed is:

1. A gas replacement system that fills a container with a content fluid, seals the container, and replaces contents of the container with a gas, comprising:

a filling machine that fills the container with the content fluid;

a sealing machine that seals the container transferred from the filling machine;

a chamber that covers the filling machine and the sealing machine, and contains an ambient gas containing a replacement gas based on a supply source; and a liquid discharge mechanism that discharges a liquid in the container having been carried into the chamber while containing the liquid out of the container in the chamber, wherein the liquid in the container is wholly replaced with the ambient gas in the chamber along with the discharge of the liquid, a gassing system that introduces the replacement gas based on the supply source into the container, the liquid in the container having been replaced with the ambient gas in the chamber along with the discharge of the liquid, to replace the ambient gas in the container with the replacement gas, and a nozzle, wherein the nozzle is downstream of the liquid discharge mechanism and upstream of the gassing system, and the nozzle is configured to spray the liquid into the container.

2. The gas replacement system according to claim 1, wherein the gassing system comprises at least a blowing nozzle which is configured to directly blow the replacement gas supplied from the supply source into an opening of the container.

3. The gas replacement system according to claim 2, wherein the chamber has three openings: an inlet for the container, an outlet for the container, and a lid supply port that carries a lid for sealing the container into the chamber, and at least one of the three openings is configured to be closed by a flow of a liquid or a flow of a gas.

4. The gas replacement system according to claim 2, wherein the blowing nozzle is configured to perform a non-seal gassing prior to the container being filled with the content fluid, wherein in the non-seal gassing the replacement gas supplied from the supply source is directly blown into the opening of the container while the opening of the container is not closed.

5. The gas replacement system according to claim 2, wherein the blowing nozzle of the gassing system is integrated with a filling nozzle of the filling machine.

6. The gas replacement system according to claim 2, wherein the blowing nozzle is configured to perform a seal gassing prior to the container being filled with the content fluid, wherein in the seal gas sing the replacement gas supplied from the supply source is directly blown into the opening of the container while the opening of the container is closed.

7. The gas replacement system according to claim 6, wherein the blowing nozzle of the gassing system is integrated with a filling nozzle of the filling machine, and the seal gassing is performed while the opening of the container is closed by the filling nozzle.

8. The gas replacement system according to claim 1, further comprising a liquid supply system that introduces the liquid into the container before the container is carried into the chamber.

9. The gas replacement system according to claim 1, wherein the liquid discharge mechanism changes a position of the container to discharge the liquid in the container from an opening of the container under its own weight.

10. The gas replacement system according to claim 1, further comprising a washing machine that washes the container with the liquid upstream of the filling machine, wherein the washing machine functions as at least one of the liquid discharge mechanism and the liquid supply system that introduces the liquid into the container before the container is carried into the chamber.

11. The gas replacement system according to claim 10, wherein the washing machine functions as the liquid discharge mechanism, and the chamber covers a position where the liquid is discharged from the container in the washing machine.

12. The gas replacement system according to claim 11, wherein the washing machine includes a gripper capable of changing a position of the container while gripping the container, and the gripper functions as the liquid discharge mechanism.

13. The gas replacement system according to claim 11, wherein a conveying path along which the container is conveyed in the washing machine includes a twist section constituted by a guide member twisted to change a position of the container while guiding the container, and the twist section functions as the liquid discharge mechanism.

14. The gas replacement system according to claim 1, wherein the sealing machine is configured to place a lid supplied into the chamber in such a manner that the lid faces the opening of the container, and the sealing machine is configured to directly blow the replacement gas supplied from the supply source toward a space between the lid and the container.

15. A gas replacement method for replacing contents of a container with a gas in filling the container with a content fluid and sealing the container, comprising:

covering a conveying path along which the container is conveyed with a chamber for the filling and sealing so that the chamber contains an ambient gas containing a replacement gas based on a supply source, and introducing a liquid into the container before the container is carried into the chamber;

discharging the liquid in the container out of the container in the chamber to wholly replace the liquid in the container with the ambient gas in the chamber;

spraying the liquid into the container using a nozzle following the discharging of the liquid;

introducing the replacement gas based on the supply source into the container, after spraying the liquid into the container, the liquid in the container having been replaced with the ambient gas in the chamber along with the discharge of the liquid, to replace the gas in the container with the replacement gas; and filling the container with a product following the introducing the replacement gas.

16. The gas replacement method according to claim 15, wherein introducing the liquid into the container includes washing the container with the liquid and introducing the liquid into the container.

17. The gas replacement method according to claim 15, wherein introducing the liquid into the container includes introducing the liquid into a plurality of containers adjacent in a conveying direction when the plurality of containers is carried into the chamber, and the container is one of the plurality of containers.

18. The gas replacement method according to claim 15, wherein the chamber has three openings: an inlet for the container, an outlet for the container, and a lid supply port that carries a lid for sealing the container into the chamber, and the covering the conveying path, the discharging the liquid and the introducing the replacement gas are conducted while at least one of the three openings is closed by a flow of a liquid or a flow of a gas.

* * * * *